United States Patent [19]

Garlinghouse

[11] 4,253,692

[45] Mar. 3, 1981

[54] CONTROL SYSTEM FOR MATERIAL PLACEMENT BUCKETS

[76] Inventor: Roland E. Garlinghouse, 2415 E. Washington Blvd., Los Angeles, Calif. 90021

[21] Appl. No.: 973,081

[22] Filed: Dec. 26, 1978

[51] Int. Cl.[3] ..... B66C 3/16; E21B 27/00

[52] U.S. Cl. ..... 294/71; 91/415; 91/442

[58] Field of Search ..... 91/415, 442, 268; 294/71; 137/102

[56] References Cited

U.S. PATENT DOCUMENTS

| | | | |
|---|---|---|---|
| 2,856,222 | 10/1958 | Gossett et al. | 294/71 |
| 3,093,153 | 6/1963 | Horowitz | 137/102 |
| 3,162,097 | 12/1964 | Allen et al. | 91/442 X |
| 3,791,690 | 2/1974 | Garlinghouse | 294/71 |
| 3,850,082 | 11/1974 | Nussbaumer | 137/102 X |

*Primary Examiner*—Irwin C. Cohen
*Attorney, Agent, or Firm*—Vernon D. Beehler

[57] ABSTRACT

A control system for opening and closing the clam shell gates of a material placement bucket makes use of a selfcompensating back pressure fluid system with a double-acting cylinder and piston. An air receiver is filled with high pressure air while air at the same pressure is being applied to the piston in a gate opening direction. At the same time, air from the receiver flowing through a pressure regulator and simultaneous exhaust valve at a reduced pressure is applied to the opposite, or reversing, side of the piston, creating back pressure. Hence the differential pressure applicable in the forward acting direction is the gate opening pressure. Closing pressure is the reduced pressure which becomes effective when pressure on the opening side is diverted to exhaust. Speed of closing the gates can be increased by adjusting only the pressure regulator to supply a higher reduced pressure. The exhausting side of the simultaneous exhaust valve standing temporarily in closed position assures a closed system on the opposite or reversing side of the piston while the system is in a gate closing cycle.

5 Claims, 3 Drawing Figures

CONTROL SYSTEM FOR MATERIAL PLACEMENT BUCKETS

This is an improvement on U.S. Pat. No. 2,856,222.

Control systems for the opening and closing of clam shell gates at the bottom of a hopper or bucket heretofore have employed a double-acting pneumatic cylinder and piston with the piston rod attached to the clam shell gates in a fashion such that application of pressure on one side of the piston serves to open the gates and application on the opposite side of the piston serves to close the gates. Buckets of the kind made reference to have been used largely for placing concrete, and also to an appreciable extent for placing granular material such as coal. The buckets made reference to, moreover, have often been of appreciable size and weight adapted to handling loads of four cubic yards, five cubic yards, ten and at times in out-loading coal or mine tailings in excess of one hundred cubic yards.

One feature of the system heretofore available and made use of consists of employment of an air receiver having a capacity in excess of the capacity of the return side of the double acting cylinder and piston combination. Air pressure from the air receiver has been conducted to the reverse acting side of the piston at a pressure appreciably lower than the full air pressure applied to the opening side of the piston whereby air on the opening side acts against back pressure on the closing side and opening movement of the piston is accomplished by the differential pressure while the cylinder and piston are being moved through the opening cycle. Air pressure and volume is built up in the air receiver so that when the opening pressure is discontinued, air stored in the receiver is made use of for the closing operation. The system is such, moreover, that should the bucket be inadvertently lifted in a fashion such as to break connection with the source of pressure, the system will automatically shift to a closing cycle as a safety expedient.

It has also been important to provide for varying the rate of opening and closing of the gates. This has been accomplished heretofore by providing in the air pressure line from the receiver to the reverse acting side of the cylinder a pressure regulator and a pressure relief or pop-off valve separated by a check valve blocking flow in a direction toward the pressure regulator and receiver while permitting flow in the opposite direction. In such a system, it is necessary to have the pressure relief valve set at a pressure higher than the pressure regulator. When there has been need to vary the speed of operation of the cylinder and piston combination, slowing the opening speed for example and accelerating the closing speed, the adjustment has been one such that the pressure regulator and the pressure relief valve must both be set for a higher pressure. Such a setting increases the closing speed and proides a greater back pressure against the pressure used for the opening cycle. At the same time, exhaust pressure, as controlled by the pressure relief valve, must be maintained slightly higher than the pressure that the pressure regulator is set for. Although this successfully accomplishes a change in adjustment for gate operation, adjustment of two separate and independent valves is necessary and the adjustment must assuredly be one which maintains the pressure in the pressure relief valve higher than the pressure for which the pressure regulator is set. The care with which such adjustments needs to be made is not always followed in the field where mechanics or operators involved are not thoroughly conversant with the pressure requirements. If the pressure relief valve is set at a pressure lower than the pressure regulator, the device will be inoperative. If pressure difference in the opposite direction is too great the operation will be faulty. If one or another of the two valves chances to be defectively calibrated, a proper setting can then be achieved only with difficulty. The circumstance is one which has caused more service calls than virtually any other portion of the mechanism. It is therefore among the objects of the invention to provide a new and improved control system for the opening and closing of gates of a material placement container whereby the speed of opening and closing can be easily and accurately varied by changing the setting of but a single valve.

Another object of the invention is to provide a new and improved control system for the opening and closing of gate means of a material placement container wherein the number of the valves required for maintaining a pressure differential between the opening and closing sides of a power cylinder is substantially minimized.

Still another object of the invention is to provide a new and improved control system for the opening and closing of gate means of a material placement container wherein the cost and complexity of the valving is materially reduced while at the same time maintaining full performance.

Still another object of the invention is to provide a new and improved control system for the opening and closing of gate means of a material placement bucket which is substantially simplified by employment of a single valve for the pressure line to the closing side of the power cylinder while at the same time preserving the full safety requirements heretofore present in the system.

Still further among the objects of the invention is to provide a new and improved control system for the opening and closing of gate means of a material placement container wherein use is made of a simultaneous exhaust valve of construction such that the simultaneous exhaust valve is responsive to virtually any pressure between the maximum and minimum limits of the reverse acting pressure line in a manner such that the simultaneous exhaust valve serves not only to shift automatically to accommodate any pressure regulator setting but also serves as a check valve against reverse flow to the pressure regulator.

With these and other objects in view, the invention consists of a construction, arrangement and combination of the various parts of the device serving as an example only of one or more embodiments of the invention, whereby the objects contemplated are attained, as hereinafter disclosed in the specification and drawings, and pointed out in the appended claims.

Figure 1:
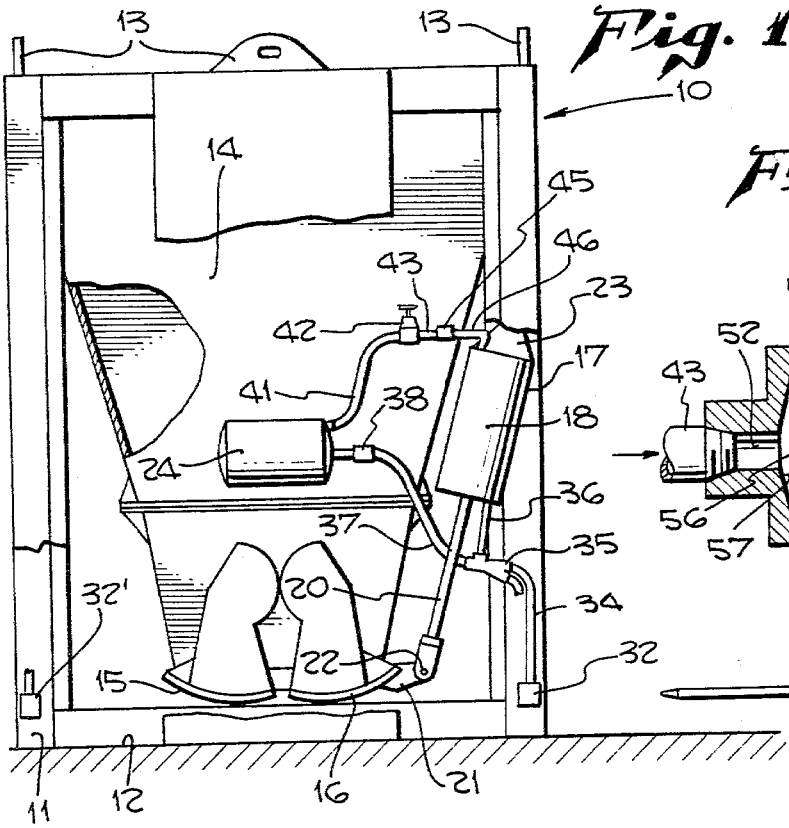
FIG. 1 is a side elevational view of a typical container such as a concrete placement bucket equipped with the control system of the invention.

In an embodiment of the invention chosen by way of illustration only there is a frame 10 having a lower edge 11 adapted to support the frame on a supporting surface 12 and at the top bales 13 serving as attachments for a suitable hoist (not shown) by means of which the frame and its contents may be lifted and moved about. In the frame there is shown a hopper or bucket 14 serving as a container for whatever material is to be handled. Although concrete is one material very commonly handled, as is also coal in a form capable of flowing out of a bucket of the type described, virtually any granular type of material may be handled in a bucket of the kind made reference to.

In this particular example, use is made of a pair of clam shell gates 15 and 16 geared together in a conventional fashion so that by manipulation of one of the clam shell gates the other will be moved simultaneously and an equal distance. Fundamentals of the system are shown and described in U.S. Pat. No. 2,856,222.

For manipulating the gates, use is made of a power-actuated ram indicated generally by the reference character 17 which consists of a cylinder 18 in which is located a reciprocating piston 19 from which extends a piston rod 20. At the free end the piston rod 20 is attached to a lug 21 of the clam shell gate 16 by means of a pivot 22. Reciprocal action of the piston rod 20 alternately swings the clam shell gate 16 to open position when the piston rod moves upwardly and to closed position when the piston rod moves downwardly. The other clam shell gate 15 moves in a complementary fashion by virtue of interconnection between the two gates. Clam shell gates are chosen as an example only since action of the system is one applicable to virtually any moving type of gate. The ram 17 at its opposite end is attached to the frame 10 by means of the lug 23, the point of attachment to the frame not being shown in detail.

Fluid receiver 24 is here shown by way of example as an air receiver anchored to the frame at an appropriate location exterior with respect to the bucket 14.

To operate the system compressed air from an appropriate exterior source is carried to the system by a high pressure line 30 to a three-way, three-position control valve 31 which is connected to the system by a connection 32. As a practical consideration in actual practice there are two connections, 32 and 32', located on opposite sides of the frame as a matter of convenience. A single selector valve 33 serves both connections and shifts from one side to the other as occasion requires so that the connection to which the high pressure line 30 is connected is opened while the other is simultaneously closed.

From the selector valve 33 a high pressure line 34 having in it a filter 35 is served by one branch 36 which leads to the cylinder 18 and another branch 37 which leads to the fluid receiver 24. A check valve 38 in the branch 37 opens for flow in the direction feeding the fluid receiver 24. For convenience, the piston 19 may be said to divide the cylinder 18 into a forward acting chamber 39 and a reverse acting chamber 40. In the example shown when the piston 19 is supplied with fluid under pressure to the forward acting chamber the piston is raised and the clam shell gate is opened whereas when pressure is supplied to the reverse acting chamber 40 the piston is lowered and the gates moved to closed position.

From the fluid receiver 24 a full pressure line 41 terminates at a pressure regulator 42 which can be set for an appreciably lower pressure.

Figure 3:
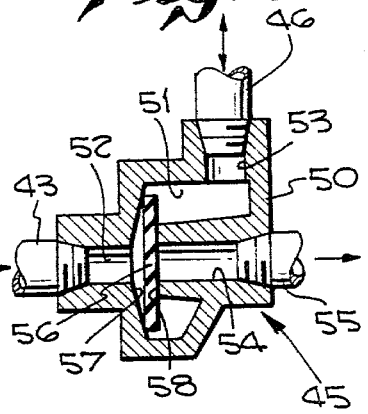
FIG. 3 is a sectional view showing details of a simultaneous exhaust valve serving as a critical component of the system.
Figure 2:
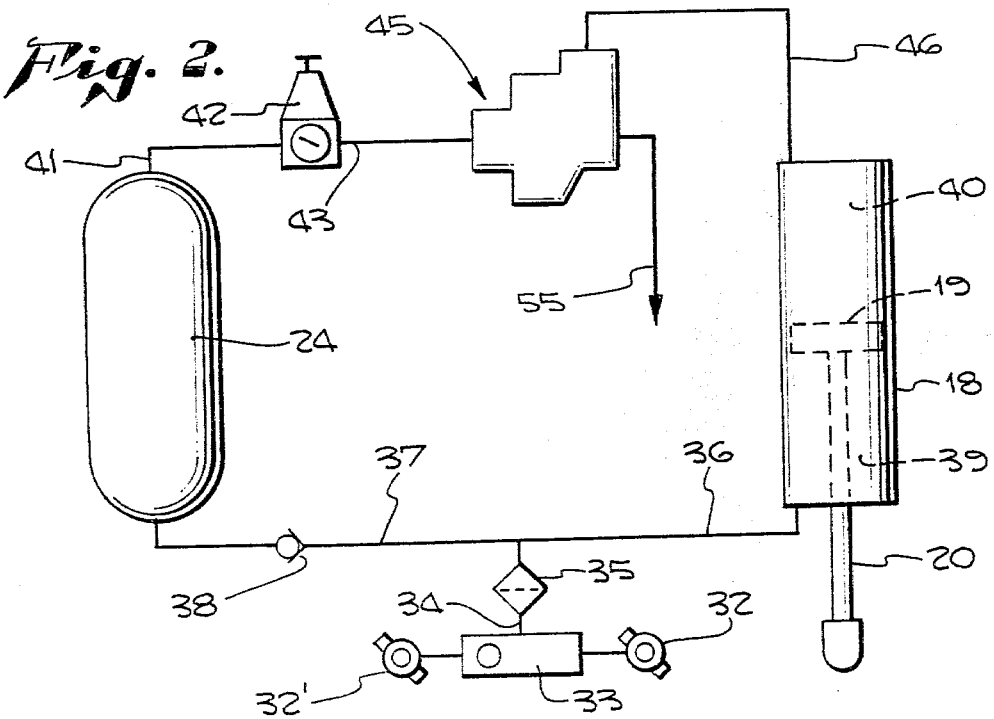
FIG. 2 is a schematic drawing showing the valving of the system.

As a consequence, a low pressure line 43 from the pressure regulator 42 communicates with a simultaneous exhaust valve 45, details of which are shown in FIG. 3. Extension 46 of the low pressure line 43 interconnects the simultaneous exhaust valve 45 with the cylinder 18 at reverse acting chamber 40. It should be noted in passing that the capacity of the fluid receiver 24 as to both volume and pressure must equal or preferably exceed the capacity of the reverse acting chamber 40.

The simultaneous exhaust valve 45 as shown comprises a valve housing 50 providing a valve chamber 51. A first port 52 connects the chamber with the low pressure line 43. A second port 53 connects the chamber with the extention 46 of the low pressure line and a third port 54 connects the chamber 51 with an exhaust line 55 which goes to atmosphere.

Within the chamber 51 is a composite flexible valve element 56 which is adapted to seat upon a valve seat 57 adjacent the first port 52 and also to seat in an opposite direction against a valve seat 58 adjacent the third port 54.

In operation let it be assumed that pressure is being supplied through the high pressure line 30 at 100 pounds per square inch. When the 100 pound pressure is applied in the customary fashion to the connection 32 for example, air at 100 pounds pressure traveling through the branch 37 past the check valve 38 fills the fluid receiver 24 at the same time that 100 pound pressure air is supplied to the forward acting chamber 39 for moving the piston rod 20 through a gate opening cycle. With the forward acting chamber having a capacity no greater than and preferably slightly less than the capacity of the fluid receiver 24, the fluid receiver will be certain to be filled with air at appropriate pressure and in volume sufficient ultimately to fill the reverse acting chamber 40 when the time comes to close the gates.

At the same time that the piston 19 is being removed upwardly air in the reverse acting chamber 40 must be exhausted. At the same time, however, by reason of the fact that the pressure regulator 42 is set, for example, at 20 pounds per square inch pressure, there is 20 pounds back pressure against the piston 19 present in the reverse acting chamber 40. This condition prevails because air at 20 pounds pressure is traveling through the low pressure line 43 and first port 52 into engagement with the left side of the valve element 56. Inasmuch as the valve element 56 is flexible, outer edges of the valve element will lift clear of the valve seat 57 permitting air at 20 pounds pressure to enter the chamber 51 and then pass outwardly through the second port 53 to the extension 46 of the low pressure line to the reverse acting chamber 40. With this pressure condition of 20 pounds being maintained, there is a pressure differential of 80 pounds per square inch acting against the lower side of the piston 19 which causes the forward acting chamber 39 to fill as the piston is opening the gates. At the same time the reverse acting chamber 40 must exhaust. To accomplish this, air which passes into the valve chamber 51 from the reverse acting chamber 40 and extension 46 flexes the inner portion of the flexible valve element 56 toward the left away from engagement with the valve seat 58 and while this condition prevails, exhaust continues through the third port 54 to the exhaust line 55 and thence to the atmosphere.

To start the reverse acting or gate closing cycle, high pressure air is disconnected from the connection 32 at which time the connection 32 serves as an exhaust for the forward acting chamber 39, or valve 31 can be shifted allowing connection 32 to exhaust, reducing pressure in the chamber 39 to zero pounds gage. At the same time, the back pressure condition continues to prevail. This is the pressure maintained by air pressure previously established in the fluid receiver 24 and set by the pressure regulator 42 at 20 pounds.

When the piston 19 is permitted to move by eliminating pressure in the forward acting chamber 39, air at 20 pounds flows from the pressure regulator 42 through the low pressure line 43 and first port 52 then past the rim of the valve element 56 which is deflected away from the valve seat 57 because of there being diminished resistance in the valve chamber 51. Air at 20 pounds pressure therefore flows through the second port 53 and extension 46 into the reverse acting chamber 40 continuing to fill the reverse acting chamber as the piston is moved downwardly through a gate closing stroke. While this condition prevails, the valve element 56 is urged to closed position against the valve seat 58 by virtue of there being 20 pounds per square inch gage pressure on the left side and zero gage pressure in the third port 54 on the right side. This condition will continue until the reverse acting chamber 40 has been filled and the piston 19 reaches the opposite end of the cylinder 18, thus achieving a full close position for the gates.

The pressure differential of 80 pounds just described is one which causes a relatively rapid opening of the gates followed by a relatively slow closing of the gates. When there is need for a slower opening cycle, as for example in topping off a form which is to be filled with concrete, a faster closing cycle will likewise be desired. To accomplish this, the pressure regulator 42 is set for a higher low pressure, as for example 35 pounds per square inch rather than 20. When this occurs, the pressure differential in the forward acting chamber will be 65 pounds rather than 80 pounds which means a slower opening cycle, namely 100 pounds acting against a back pressure of 35 pounds. At completion of the opening cycle, there will be 35 pounds per square inch pressure in the reverse acting chamber 40, acting against zero pounds per square inch gage pressure in the forward acting chamber. As a consequence, the reverse action of the piston 19 will be more positive and rapid causing the gates to close more rapidly. When this condition prevails, the flow of concrete can be more readily cut off when a form is being topped off. This has been accomplished by merely adjusting a single pressure regulator valve 42.

Having described the invention, what is claimed as new in support of Letters Patent is as follows:

1. A control system for opening and closing the gate means of a material placement container, said control system comprising clam shell gate means, a double-acting cylinder operating said clam shell gate means and having respective gate opening and gate closing sides and a piston in operating association with the gate means, a fluid pressure receiver, a high pressure fluid supply line having a supply end adapted to be connected in the alternative to a high pressure fluid supply and to exhaust, said high pressure fluid supply line being connected to said receiver and to the gate opening side of said cylinder, a low pressure fluid supply line from said receiver to the gate closing side of said cylinder, a pressure regulator in said low pressure fluid supply line, a simultaneous exhaust valve in said low pressure fluid supply line between said regulator and the gate closing side of said cylinder, said simultaneous exhaust valve having a chamber therein with a first port in exclusive constant communication with said pressure regulator and continuously subject to said low pressure fluid supply, a second port in communication with the gate closing side of said cylinder and a third port adapted to communicate with the atmosphere for exhausting said gate closing side, one valve seat of said exhaust valve being in communication with said first port, another valve seat of said exhaust valve being in communication with said third port, and a self acting pressure responsive valveelement in said chamber being constantly acted upon by said constant low pressure fluid supply at said first port and having a succession of positions relative to said valve seats, said valve element in one of said succession of positions being closed against said first port and subject to said low pressure fluid supply and the pressure therein, said valve element being adapted to effect an opening between said second and third ports only when pressure in the gate closing side of said cylinder exceeds that of the low pressure fluid supply whereby said gate closing side of said cylinder is exahusted, said valve element in another of said succession of positions being adapted to effect an opening between said first and second ports when said gate opening side of the cylinder is open to atmosphere and while having a closed position relative to said third port whereby all of the pressure determined by said regulator is applied to the closing side of said cylinder while the opening side is connected to exhaust.

2. A control system as in claim 1 wherein said valve element has a first portion which seats on said first port and a second portion which seats on said third port, said portions being capable of operation independent of each other.

3. A control system as in claim 1 wherein said valve element is a single member flexible in opposite directions.

4. A control system as in claim 3 wherein said valve seats are concentric with said one seat having a relatively larger diameter and said other seat having a relatively smaller diameter.

5. A control system as in claim 1 wherein said first and third ports face each other in opposite directions.

* * * * *